United States Patent [19]

Sreekumar

[11] Patent Number: 4,869,992

[45] Date of Patent: Sep. 26, 1989

[54] MIXED POLYMER TONER FOR FORMING ELECTROGRAPHIC PRINTING PLATES

[75] Inventor: Chandra Sreekumar, Rochester, N.Y.

[73] Assignee: Eastman Kodak Company, Rochester, N.Y.

[21] Appl. No.: 212,469

[22] Filed: Jun. 28, 1988

[51] Int. Cl.[4] ..... G03G 9/08; G03G 13/22

[52] U.S. Cl. ..... 430/137; 430/109; 264/12; 264/13

[58] Field of Search ..... 430/137, 109; 264/12, 264/13

[56] References Cited

U.S. PATENT DOCUMENTS

| | | | |
|---|---|---|---|
| 3,561,003 | 2/1971 | Lanham et al. | 106/22 |
| 3,830,750 | 8/1974 | Wellman | 252/316 |
| 3,965,021 | 6/1976 | Clemens et al. | 430/109 |
| 3,974,078 | 8/1976 | Crystal | 430/109 |
| 4,288,516 | 9/1981 | Gaudioso | 430/109 X |
| 4,489,150 | 12/1984 | Chang et al. | 430/109 X |

FOREIGN PATENT DOCUMENTS

| | | | |
|---|---|---|---|
| 1522628 | 10/1969 | Fed. Rep. of Germany | 430/137 |
| 2508095 | 4/1975 | Fed. Rep. of Germany | 430/137 |
| 55-6340 | 1/1980 | Japan | 430/109 |
| 56-65146 | 6/1981 | Japan | 430/109 |
| 60-90344 | 5/1985 | Japan | 430/109 |
| 60-263954 | 12/1985 | Japan | 430/109 |
| 61-91666 | 5/1986 | Japan | 430/137 |
| 62-63940 | 3/1987 | Japan | 430/109 |
| 2017949 | 10/1979 | United Kingdom | 430/109 |

*Primary Examiner*—Paul R. Michl
*Assistant Examiner*—Jeffrey A. Lindeman
*Attorney, Agent, or Firm*—Bernard D. Wiese

[57] ABSTRACT

Disclosed is a method of making particulates. A solution is formed of a solvent. a first polymer having an intrinsic viscosity of at least 0.5, and a second polymer having an intrinsic viscosity of less than 0.5. The solution is atomized with a gas to form droplets of the solution suspended in the gas. The evaporation of the solvent leaves the particles suspended in the gas and the particles are collected to form the toner. Also disclosed is toner made by this method, and a method of making an electrographic printing plate by developing an electrostatic image with the toner, transferring the developed image to a substrate, and fixing the transferred image on the substrate. Also disclosed is an electrographic printing plate made according to that method.

11 Claims, No Drawings

MIXED POLYMER TONER FOR FORMING ELECTROGRAPHIC PRINTING PLATES

FIELD OF THE INVENTION

This invention relates to the formation of toners for use in preparing electrographic printing plates. More particularly, it relates to toners made by a spray-drying process using a mixture of a polymer having an intrinsic viscosity of at least 0.5 and a polymer having an intrinsic viscosity of less than 0.5.

BACKGROUND OF THE INVENTION

Electrographic printing plates are substrates on which an image is embossed. Multiple copies of the embossed image can be prepared by the application of ink or pigment to the printing plate and the transfer of that ink or pigment to paper or another receiver.

Electrographic printing plates can be prepared by electrostatography. For example, a latent electrostatic image can be formed on a photoconductor by, for example, optical or other means. The latent electrostatic image can then be developed with a toner and the developed image can be transferred to a substrate and fixed to form the electrographic printing plate.

Toners used for this purpose must be specially formulated to withstand the abuse that they receive during the production of multiple copies made from the printing plate. It has been found to be difficult to formulate a toner that will not abrade during the production of those copies and that is sufficiently adherent to the substrate so that it will not peel off the substrate during use.

SUMMARY OF THE INVENTION

We have discovered that a toner can be prepared that has synergistically improved wear properties. That is, the toner of this invention is a mixture of two polymers of differing intrinsic viscosities, and it has wear properties that are superior to toners made from either of the polymers used to form the mixture. We have found that, unlike other toners, when the toner of this invention is fused on a substrate, the polymer of higher intrinsic viscosity forms a discontinuous phase within a semi-continuous phase formed by the polymer of lower intrinsic viscosity. While we do not wish to be bound by any theories, we believe that this unique structure is responsible for the remarkably improved wear properties of the toner of this invention.

DESCRIPTION OF THE PREFERRED EMBODIMENTS

The toners of this invention are prepared according to a spray-drying process. In a spray-drying process a solution of a polymer is prepared and the solution is atomized with a gas to form droplets of the solution suspended in the gas. The solvent in the solution evaporates leaving particles of the toner suspended in the gas; the suspended particles are then collected. The spray-drying process for preparing particulates is well known; see, for example, U.S. Pat. Nos. 3,561,003 and 3,830,750, herein incorporated by reference.

In this invention, the solution used in the spray-drying process contains not a single polymer, but a mixture of two polymers which have different intrinsic viscosities. One polymer, which can be described as a "tough" polymer has an intrinsic viscosity of at least 0.5. The second polymer, which can be described as a "brittle" polymer, has an intrinsic viscosity of less than 0.5. Intrinsic viscosity is a standard chemical measurement.

Among the various polymers which can be employed in the toner particles of the present invention are polycarbonates, resin-modified maleic alkyd polymers, polyamides, phenol-formaldehyde polymers and various derivatives thereof, polyester condensates, modified alkyd polymers, aromatic polymers containing alternating methylene and aromatic units such as described in U.S. Pat. No. 3,809,554 and fusible crosslinked polymers as described in U.S. Patent No. Re 31,072.

Typical useful toner polymers include polycarbonates such as those described in U.S. Pat. No. 3,694,359, which include polycarbonate materials containing an alkylidene diarylene moiety in a recurring unit and having from 1 to about 10 carbon atoms in the alkyl moiety. Other useful polymers having the above-described physical properties include polymers of acrylic and methyacrylic acid such as poly(alkyl acrylate), and poly(alkyl methacrylate) wherein the alkyl moiety can contain from 1 to about 10 carbon atoms. Additionally, other polyesters having the aforementioned physical properties are also useful. Among such other useful polyesters are copolyesters prepared from terephthalic acid (including substituted terephthalic acid), a bis(hydroxyalkoxy)phenylalkane having from 1 to 4 carbon atoms in the alkoxy radical and from 1 to 10 carbon atoms in the alkane moiety (which can also be a halogen-substituted alkane), and an alkylene glycol having from 1 to 4 carbon atoms in the alkylene moiety.

Other useful polymers are styrene-containing polymers. Such polymers can comprise, e.g., a polymerized blend of from about 40 to about 100% by weight of styrene, from 0 to about 45% by weight of a lower alkyl acrylate or methacrylate having from 1 to about 4 carbon atoms in the alkyl moiety such as methyl, ethyl, isopropyl, butyl, etc. and from about 5 to about 50% by weight of another vinyl monomer other than styrene, for example, a higher alkyl acrylate or methacrylate having from about 6 to 20 or more carbon atoms in the alkyl group. Typical styrene-containing polymers prepared from a copolymerized blend as described hereinabove are copolymers prepared from a monomeric blend of 40 to 60% by weight styrene or styrene homolog, from about 20 to about 50% by weight of a lower alkyl acrylate or methacrylate and from about 5 to about 30% by weight of a higher alkyl acrylate or methacrylate such as ethylhexyl acrylate (e.g., styrene-butyl acrylate-ethylhexyl acrylate copolymer). Preferred fusible styrene copolymers are those which are covalently crosslinked with a small amount of a divinyl compound such as divinylbenzene. A variety of other useful styrene-containing toner materials are disclosed in U.S. Pat. Nos. 2,917,460; Re. 25,316; 2,788,288; 2,638,416; 2,618,552 and 2,659,670.

The preferred tough polymer is a branched polyester having an intrinsic viscosity over 0.5 made from 42 mole percent dimethyl terephthalate, 50 mole percent propylene glycol, 5 mole percent dimethyl glutarate, and 3 mole percent glycerol because it is suitable for making a printing plate. The preferred brittle polymer is made from 45 mole percent dimethyl terephthalate, 5 mole percent dimethyl glutarate, and 50 mole percent propylene glycol, and has an intrinsic viscosity of 0.15.

The two polymers used may be mutually unreactive or they can be selected so as to react upon contact, during fixing, or under other conditions. The two polymers may also be either mutually miscible or mutually immiscible.

The weight ratio of tough polymer to brittle polymer should be between about 1 to 4 and about 4 to 1 because if too much brittle polymer is present the fixed toner will offer poor abrasion resistance and if too much tough polymer is present the fixed toner will have poor adhesion to the substrate. A preferred weight ratio of tough polymer to brittle polymer is between about 2 to 3 and about 3 to 2.

A solution can be formed by dissolving both polymers in a solvent. While any solvent can be used and the selection of a solvent is not critical, it is, of course, preferable to select a low-boiling solvent to reduce the expenditure of energy necessary to evaporate the solvent during the spray-drying process. For obvious reasons, it is also advantageous to select inexpensive and non-toxic solvents. The amount of solvent used will depend upon the particular polymers that must be dissolved. However, sufficient solvent should be used to not only dissolve both polymers but to also give the resulting solution the viscoelastic properties needed for spray-drying. That is, sufficient solvent must be used so that the resulting solution has a viscosity that is low enough to spray-dry; a viscosity between about 5 and about 10 centipoise is usually adequate.

There may be circumstances in which it is desirable to produce toner particles that are irregular or non-spherical. As described in copending application, Ser. No. 212,466 filed June 28, 1988 titled "Toner Particles Having Irregular Surfaces," herein incorporated by reference, this can be accomplished by the addition to the solution of a miscible higher-boiling non-solvent which does not form an azeotrope with the solvent. In order to make the most irregular particles, the maximum amount of non-solvent should be used that can be present without causing the precipitation of the polymer. For a typical polymer, the solvent may be about 35 to 50%, and the non-solvent about 50 to about 65%, by weight of the weight of the polymer, solvent, and non-solvent.

Various kinds of well-known addenda (e.g., colorants, release agents, etc.) can also be incorporated into the toners of the invention.

Numerous colorant materials selected from dyestuffs or pigments can be employed in the toner materials of the present invention. Such materials serve to color the toner and/or render it more visible. Of course, suitable toner materials having the appropriate charging characteristics can be prepared without the use of a colorant material where it is desired to have a developed image of low optical density. In those instances where it is desired to utilize a colorant, the colorants can, in principle, be selected from virtually any of the compounds mentioned in the Colour Index Volumes 1 and 2, Second Edition.

Included among the vast number of useful colorants are such materials as Hansa Yellow G (C.I. 11680), Nigrosine Spirit soluble (C.I. 50415), Chromogen Black ETOO (C.I. 45170), Solvent Black 3 (C.I. 26150), Fuchsine N (C.I. 42510), C.I. Basic Blue 9 (C.I. 52015). The preferred colorant is carbon because it is the most commonly used colorant. The amount of colorant added may vary over a wide range, but from about 0.5 to about 2% of the weight of the polymer usually produces good results. If an electrographic printing plate is being prepared, there is no need for a colorant other than to render the image of the toner on the substrate more visible. Suitable substrates that can be used include grained anodized aluminum plate, aluminized paper, etc.

The following example further illustrates this invention.

EXAMPLE

In this example 300 grams of a branched polyester formed from terephthalic acid, propylene glycol, dimethyl glutarate, and glycerol having an intrinsic viscosity 0.22 (a "brittle" resin) was mixed with 300 grams of a similar polyester prepared from the same materials but having an intrinsic viscosity of 0.5 (a "tough" resin). The mixture was dissolved in 800 grams of dichloromethane, a solvent for the polymer, and 500 grams of heptane, a non-solvent for the polymer was mixed with the solution. The resulting dispersion was sprayed with a jet atomizer having a flow rate of 40 mL of liquid per minute at a back pressure of nitrogen gas operating at 40 psi. The solvent evaporated almost instantaneously, followed by the non-solvent, leaving suspended particles which were collected with a cyclone arrangement designed to separate at 4 um. The yield of 4 micron sized particles collected was 60% by weight. Photomicrographs of the fused toner showed that it has a unique structure of tough toner particles held in a semi-continuous phase of fused brittle toner. The toner was mixed with a carrier and the resulting developer was used to develop an electrophotographic latent image which was subsequently transferred and fixed on paper. The same system was used to develop another image which was transferred to a grained anodized aluminum plate.

The invention has been described in detail with particular reference to preferred embodiments thereof, but it will be understood that variations and modifications can be effected within the spirit and scope of the invention.

We claim:

1. A method of making toner particles which comprises:

(A) forming a solution of a first polymer having an intrinsic viscosity of at least 0.5 with a second polymer having an intrinsic viscosity of less than 0.5 in a solvent for the polymers, (B) forming a dispersion by mixing the polymer solution with a miscible non-solvent for the polymers, the non-solvent being a liquid that has a higher boiling point than the solvent and does not form an azeotrope with the solvent, (C) atomizing the dispersion with a gas to form droplets suspended in the gas; and (D) evaporating the solvent and then the non-solvent to provide the toner particles.

2. A method according to claim 1 wherein said first and second polymers are polyesters.

3. A method according to claim 1 wherein said solvent is dichloromethane.

4. A method according to claim 1 wherein the weight ratio of said first polymer to said second polymer is about 1:4 to about 4:1.

5. A method according to claim 5 wherein the weight ratio of said first polymer to said second polymer is about 2:3 to about 3:2.

6. A method according to claim 1 wherein said gas is nitrogen.

7. A method according to claim 1 wherein said solution includes about 0.5 to about 2% by weight, based on total solution weight, of a colorant.

8. Toner particles made according to the method of claim 1.

9. A method of making an electrographic printing plate comprising developing an electrostatic image with a toner according to claim 8, transferring the developed image to a substrate, and fixing the transferred image on said substrate.

10. An electrographic printing plate made according to the method of claim 9.

11. An electrographic printing plate comprising a substrate to which is fixed a toner which comprises a semi-continuous phase which comprises a polymer having an intrinsic viscosity of at least 0.5, and a discontinuous phase which comprises a polymer having an intrinsic viscosity less than 0.5.

* * * * *